US005697386A

United States Patent [19]

Chang

[11] Patent Number: 5,697,386

[45] Date of Patent: Dec. 16, 1997

[54] HAIR BAND

[76] Inventor: Wen-Shyong Chang, No. 7, Alley 116, Lane 175, Sec. 1, Ta Tung Rd., Tainan City, Taiwan

[21] Appl. No.: 652,990

[22] Filed: May 24, 1996

[51] Int. Cl.[6] ..... A45D 8/36

[52] U.S. Cl. ..... 132/273; D28/41; 2/174

[58] Field of Search ..... 132/273, 275; 2/171, 174, 181, 209, DIG. 11; D28/33, 41

[56] References Cited

U.S. PATENT DOCUMENTS

| | | | |
|---|---|---|---|
| 2,849,007 | 8/1958 | Behr | 132/275 |
| 5,035,005 | 7/1991 | Hung | 2/209 |
| 5,131,094 | 7/1992 | Ackerman | 2/12 |
| 5,390,369 | 2/1995 | Tubin | 2/12 |
| 5,449,008 | 9/1995 | Yeh | 132/273 |

*Primary Examiner*—Todd E. Manahan
*Attorney, Agent, or Firm*—Charles E. Baxley, Esq.

[57] ABSTRACT

A hair band of flexible material includes a body, two hair retaining portions respectively attached to two ends of the body and being of a first curvature, and two extension plates respectively attached to the hair retaining portions and being of a second curvature. Each hair retaining portion includes an elongate receiving hole defined therein and extending along a longitudinal direction thereof. A slot is defined in a medial portion of each hair retaining portion, thereby defining an engaging section at a distal end of the hair retaining portion. Each engaging section has a passage defined therein which communicates an outside with the elongate receiving hole. Each extension plate has a width slightly smaller than that of the associated passage and also smaller than that of the associated elongate receiving hole and includes a plurality of spaced snapping protrusions formed on a side thereof, a distance between two adjacent snapping protrusions being slightly greater than a length of the engaging section. Each protrusion is sized to allow the extension plate to be forcibly passed through the passage, thereby allowing the engaging section to be selectively, securely held between two adjacent snapping protrusions.

3 Claims, 3 Drawing Sheets

HAIR BAND

BACKGROUND OF THE INVENTION

1. Field of the invention

The present invention relates to a hair band and, more particularly, to a hair band which allows adjustment of a length thereof.

2. Description of the Related Art

Hair bands are a common article for modern women to take care of their hair and to achieve an ornamentation purpose. A conventional hair band is substantially an arcuate piece integrally formed of flexible material by heat pressing and a surface thereof is treated by baked finish, gold plating, etc, thereby providing an attractive appearance. Nevertheless, the manufactures have to produce at least three sizes for each specific appearance of the hair hands to meet users having different sizes of heads (e.g., for children and adults), resulting in an increase in the cost. In addition, the hair bands become very personal, i.e., a hair band fitting a person may not fit another as a length thereof is not adjustable.

Therefore, there has been a long and unfulfilled need for an improved hair band to mitigate and/or obviate the above problems.

SUMMARY OF THE INVENTION

A hair band in accordance with the present invention is formed of flexible material and including a body, two hair retaining portions respectively attached to two ends of the body and being of a first curvature, .and two extension plates respectively attached to the hair retaining portions and being of a second curvature. Each hair retaining portion includes an elongate receiving hole defined therein and extending along a longitudinal direction thereof. A slot is defined in a mediate portion of each hair retaining portion, thereby defining an engaging section at a distal end of the hair retaining portion. Each engaging section has a retaining edge defining the slot and a passage defined therein which communicates an outside with the elongate receiving hole.

Each extension plate has a width slightly smaller than that of the associated passage and also smaller than that of the associated elongate receiving hole and includes a plurality of spaced snapping protrusions formed on a side thereof, a distance between each two adjacent snapping protrusions being slightly greater than a length of the engaging section. Each protrusion is sized to allow the extension plate to be forcibly passed through the passage, thereby allowing the engaging section to be selectively, securely held between two adjacent snapping protrusions.

In one embodiment of the invention, each engaging section includes a contacting surface such that when the hair band is put on a head of a user, the contact surfaces lie in a plane parallel to two lateral sides of the head of the user, thereby providing a comfortable feeling during wearing.

In a preferred embodiment of the invention, each extension plate includes a stop member formed on the side thereof adjacent to a first end thereof, and a distance between the stop member and an adjacent protrusion is slightly greater than the length of the engaging section. The stop member includes an inclined surface which tapers from a second end of the extension plate to the first end of the extension plate. The inclined surface allows the stop member to be forcibly inserted into the slot, while the stop member has a height so sized that the stop member, after being inserted into the slot, is stopped by the retaining edge and thus cannot be detached from the associated hair retaining portion.

Other objects, advantages, and novel features of the invention will become more apparent from the following detailed description when taken in conjunction with the accompanying drawings.

DESCRIPTION OF THE PREFERRED EMBODIMENT

Figure 1:
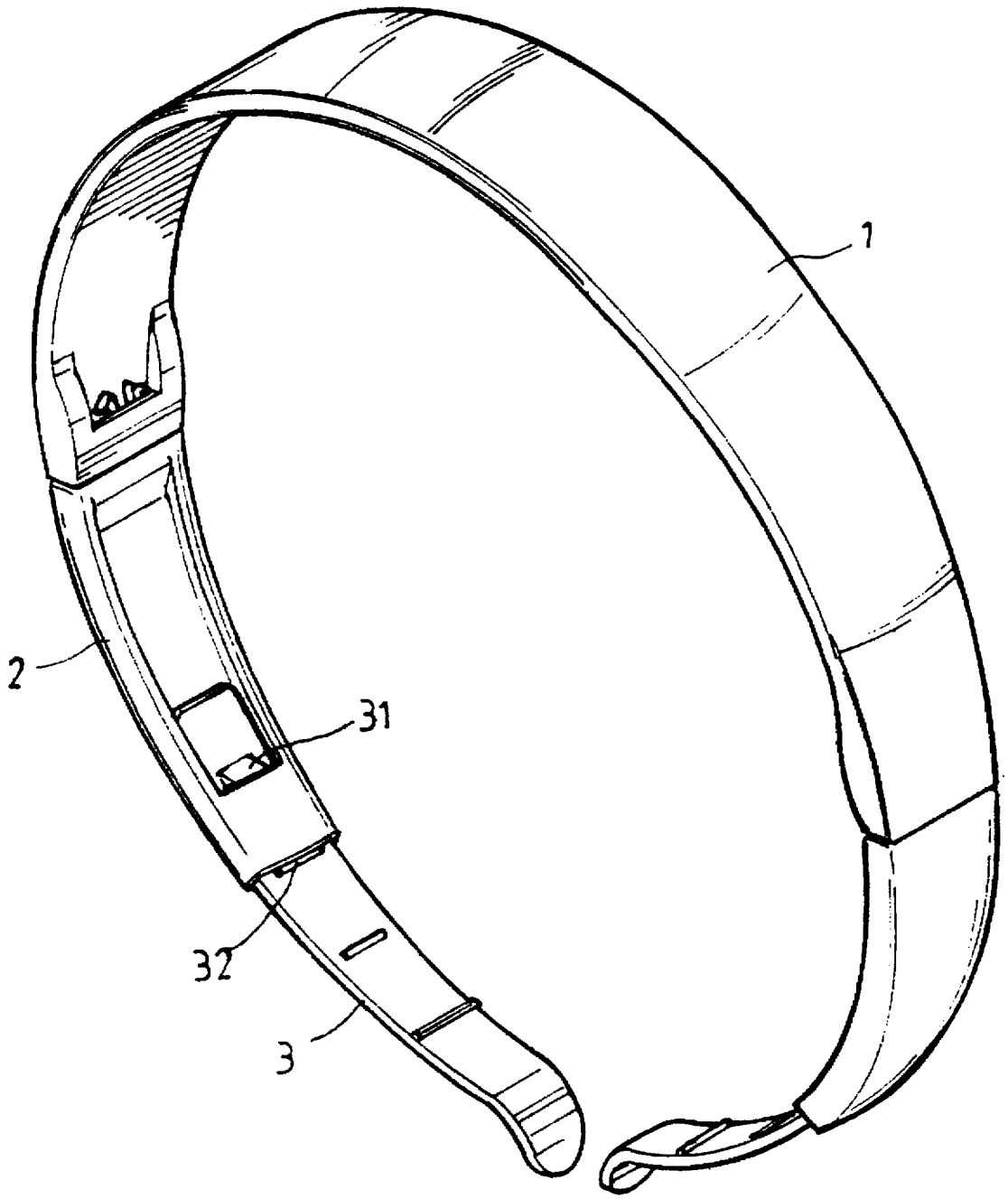
FIG. 1 is a perspective view of a hair band in accordance with the present invention.
Figure 2:
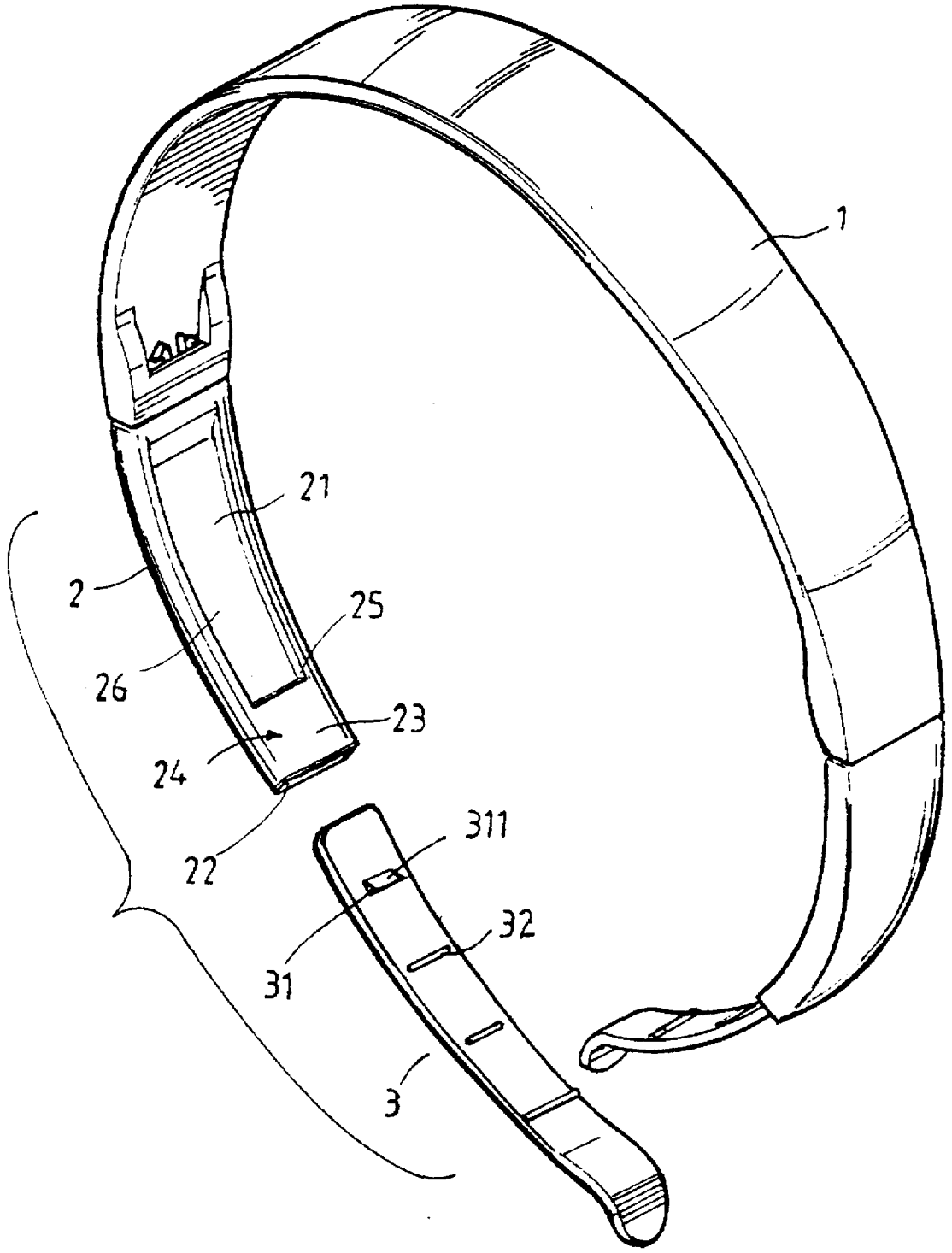
FIG. 2 is an exploded perspective view of the hair band in accordance with the present invention.
Figure 3:
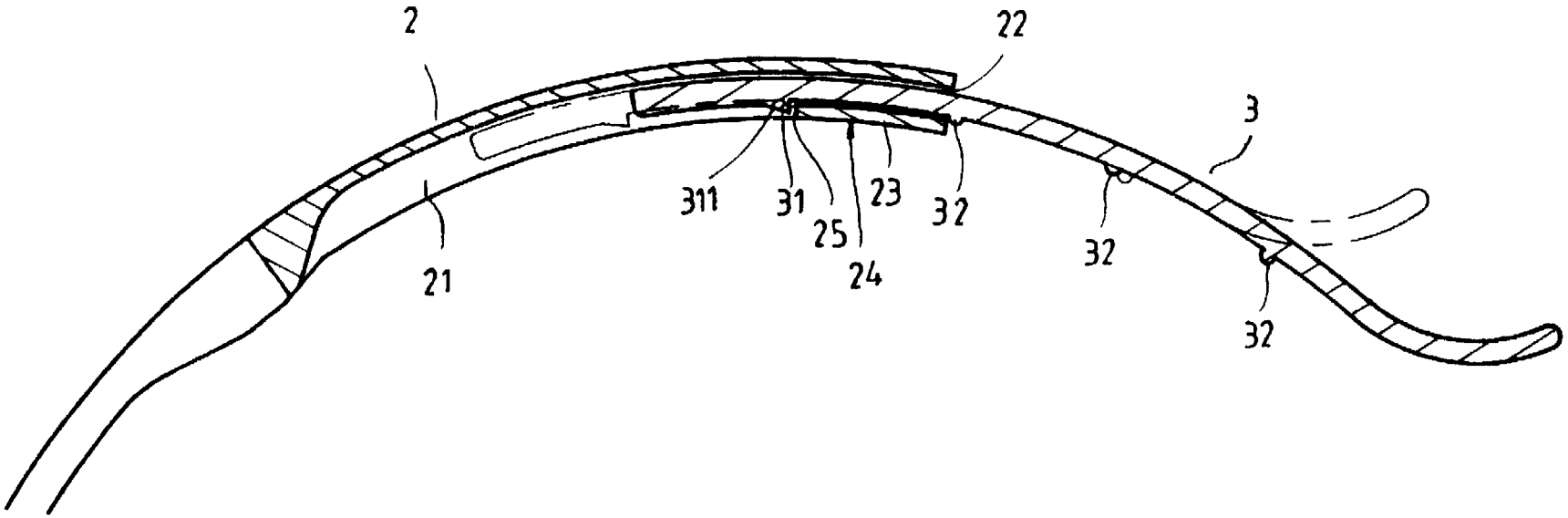
FIG. 3 is a cross-sectional view illustrating adjustment of a length of the hair band.

Referring to FIGS. 1 to 3 of the drawings and initially to FIGS. 1 and 2, a hair band in accordance with the present invention is formed of flexible material and includes a substantially arcuate body 1, two hair retaining portions 2 which face each other, and two extension plates 3 respectively attached to the hair retaining portions 2. The hair retaining portions 2 can be releasably detached to two ens of the body 1, respectively, or integrally formed with the body 1.

Referring to FIG. 2, each hair retaining portion 2 is of a suitable curvature and includes an elongate receiving hole 21 defined therein and extending along a longitudinal direction thereof. A slot 26 is defined in a mediate portion of each hair retaining portion 2, thereby defining an engaging section 24 on a distal end of the hair retaining portion 2. The engaging section 24 has a passage 22 defined therein which communicates an outside with the elongate engaging hole 21. Each engaging section 24 further includes a contacting surface 23. When the hair band is put on a head of a user, the contact surfaces 23 lie in a plane parallel to two lateral sides of the head of the user, thereby providing a comfortable feeling during wearing. The engaging section 24 includes a retaining edge 25 defining the slot 26, which will be described later.

Each extension plate 3 is also of a suitable curvature and includes a stop member 31 formed on a side adjacent to a first end thereof and a plurality of spaced snapping protrusions 32 formed on the side thereof. A distance between the stop member 31 and the adjacent snapping protrusion 32 and a distance between each two adjacent snapping protrusions 32 are both slightly greater than a length of the engaging section 24, as shown in FIG. 3. Furthermore, the stop member 31 includes an inclined surface 311 which tapers from a second end of the extension plate 3 to the first end of the extension plate 3. Both of the elongate receiving hole 21 and the passage 22 include a width slightly greater than that of the extension plate 3, thereby allowing the later to extend therethrough.

In use, each extension plate 3 is inserted into the associated slot 26 by passing the first end thereof through the passage 22. The inclined surface 311 of the stop member 31 allows the extension plate 3 to be forcibly passed through the passage 22 into the slot 21 to a position shown in FIG. 3, yet the stop member 31 cannot be disengaged from the slot 21 as the stop member 31 has a certain height so as to be stopped by the retaining edge 25 yet not interfering with the insertion thereof, while the engaging section 24 is held between the stop member 31 and an adjacent protrusion 32. Nevertheless, the height of each protrusion 32 is so sized that an overall thickness of the extension plate 3 (the thickness of the extension plate 3 plus the height of the protrusion 32) is only slightly greater than a height of the passage 22 and thus allows the protrusion 32 to be forcibly passed through the passage 22 to a desired position, e.g., as shown in FIG. 3, the user may push the extension plate 32 inwardly to a position shown by phantom lines in which the stop member 31 moves away from the retaining edge 25, and the engaging section 24 is held between two adjacent protrusions 32. In brief, the engaging section 24 may be selectively, securely held between each two adjacent protrusions 32 or between the stop member 31 and the adjacent protrusion 32.

Alternatively, the stop member 31 can be replaced by a protrusion 32 to allow removal of the extension plate 3 from the hair retaining end portion 2, if desired.

Although the invention has been explained in relation to its preferred embodiment, it is to be understood that many other possible modifications and variations can be made without departing from the spirit and scope of the invention as hereinafter claimed.

What is claimed is:

1. A hair band formed of flexible material and comprising:

a body having two ends, two hair retaining portions respectively attached to the two ends of the body and being of a first curvature, and two extension plates respectively attached to said hair retaining portions and being of a second curvature, each said hair retaining portion including an elongate receiving hole defined therein and extending along a longitudinal direction thereof, a slot being defined in a medial portion of each said hair retaining portion, thereby defining an engaging section at a distal end of said hair retaining portion, each said engaging section having a retaining edge defining the slot and a passage defined therein which communicates an outside with said elongate receiving hole;

each said extension plate having a width slightly smaller than that of the associated passage and also smaller than that of the associated elongate receiving hole and including a plurality of spaced snapping protrusions formed on a side thereof, a distance between each two adjacent said snapping protrusions being slightly greater than a length of the engaging section, and each said protrusion being sized to allow said extension plate to be forcibly passed through said passage, thereby allowing said engaging section to be selectively, securely held between two adjacent said snapping protrusions.

2. The hair band as claimed in claim 1, wherein each said engaging section including a contacting surface such that when the hair band is put on a head of a user, the contact surfaces lie in a plane parallel to two lateral sides of the head of the user, thereby providing a comfortable feeling during wearing.

3. The hair band as claimed in claim 1, wherein each said stop member further including a stop member formed on the side thereof adjacent to a first end thereof and a distance between the stop member and an adjacent said protrusion is slightly greater than said length of said engaging section, said stop member including an inclined surface which tapers from a second end of said extension plate to said first end of said extension plate, said inclined surface allowing said stop member to be forcibly inserted into said slot, and said stop member having a height so sized that said stop member, after being inserted into the engaging slot, is stopped by the retaining edge and thus cannot be detached from the associated hair retaining portion.

* * * * *